US010915063B2

(12) United States Patent
Yoshida

(10) Patent No.: US 10,915,063 B2
(45) Date of Patent: Feb. 9, 2021

(54) REMOVABLE UNIT AND IMAGE FORMING APPARATUS INCORPORATING SAME

(71) Applicant: Tomofumi Yoshida, Kanagawa (JP)

(72) Inventor: Tomofumi Yoshida, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 16/535,443

(22) Filed: Aug. 8, 2019

(65) Prior Publication Data

US 2020/0089162 A1 Mar. 19, 2020

(30) Foreign Application Priority Data

Sep. 14, 2018 (JP) ..... 2018-172055

(51) Int. Cl.
*G03G 21/18* (2006.01)
*G03G 21/16* (2006.01)
*G03G 15/00* (2006.01)

(52) U.S. Cl.
CPC ..... *G03G 21/1867* (2013.01); *G03G 15/80* (2013.01); *G03G 21/1652* (2013.01); *G03G 2221/1884* (2013.01)

(58) Field of Classification Search
CPC . G03G 21/1867; G03G 15/80; G03G 21/1652
See application file for complete search history.

(56) References Cited

U.S. PATENT DOCUMENTS

2006/0198645 A1 9/2006 Yamada et al.
2007/0140763 A1 6/2007 Shimizu et al.
2008/0095559 A1 4/2008 Shimizu et al.
2008/0145108 A1 6/2008 Yoshida et al.
2008/0145109 A1 6/2008 Murayama et al.
2008/0145119 A1 6/2008 Tatsumi et al.
2008/0187358 A1 8/2008 Kubota et al.
2008/0199204 A1* 8/2008 Ishii ..... G03G 15/55 399/90
2008/0205930 A1 8/2008 Kawakami et al.
2008/0219698 A1 9/2008 Shimizu et al.
2008/0267661 A1 10/2008 Yoshida et al.
2008/0279586 A1 11/2008 Tatsumi et al.
2009/0022531 A1 1/2009 Kubota et al.
2009/0110430 A1 4/2009 Kubota et al.
2009/0154973 A1* 6/2009 Shimizu ..... G03G 21/105 399/358
2009/0162101 A1 6/2009 Yoshida et al.
2009/0169246 A1* 7/2009 Ooyoshi ..... G03G 21/1821 399/111

(Continued)

FOREIGN PATENT DOCUMENTS

JP 8-248767 9/1996
JP 2013-003500 1/2013
JP 2013-213990 10/2013

*Primary Examiner* — Walter L Lindsay, Jr.
*Assistant Examiner* — Jessica L Eley
(74) *Attorney, Agent, or Firm* — Oblon, McClelland, Maier & Neustadt, L.L.P.

(57) ABSTRACT

A removable unit is removably installed in an apparatus. The removable unit includes a plurality of powered components, a power supply connector configured to electrically connect a power supply of the apparatus and the plurality of powered components. The power supply connector is configured to change a combination of respective voltages applied to the plurality of powered components.

13 Claims, 8 Drawing Sheets

(56) References Cited

U.S. PATENT DOCUMENTS

| | | | | |
|---|---|---|---|---|
| 2009/0169265 | A1 | 7/2009 | Yoshida et al. | |
| 2011/0052255 | A1* | 3/2011 | Yoshida | G03G 21/1821 399/111 |
| 2012/0033982 | A1 | 2/2012 | Kubota et al. | |
| 2012/0063806 | A1 | 3/2012 | Kubota et al. | |
| 2012/0114373 | A1 | 5/2012 | Hamada et al. | |
| 2012/0189326 | A1 | 7/2012 | Yoshida et al. | |
| 2012/0189327 | A1 | 7/2012 | Kubota et al. | |
| 2012/0328320 | A1 | 12/2012 | Fujita et al. | |
| 2013/0051864 | A1 | 2/2013 | Mitani et al. | |
| 2013/0136465 | A1 | 5/2013 | Yoshida et al. | |
| 2013/0183065 | A1 | 7/2013 | Nakamura et al. | |
| 2013/0236197 | A1 | 9/2013 | Yoshida et al. | |
| 2013/0266336 | A1* | 10/2013 | Maeda | G03G 15/1605 399/90 |
| 2015/0063865 | A1 | 3/2015 | Furuichi et al. | |
| 2015/0132026 | A1 | 5/2015 | Yoshida et al. | |
| 2015/0286163 | A1 | 10/2015 | Yoshida et al. | |
| 2015/0293492 | A1* | 10/2015 | Matsumura | G03G 21/1867 399/27 |
| 2018/0253032 | A1 | 9/2018 | Yoshida et al. | |

* cited by examiner

REMOVABLE UNIT AND IMAGE FORMING APPARATUS INCORPORATING SAME

CROSS-REFERENCE TO RELATED APPLICATION

This patent application is based on and claims priority pursuant to 35 U.S.C. § 119(a) to Japanese Patent Application No. 2018-172055, filed on Sep. 14, 2018, in the Japan Patent Office, the entire disclosure of which is hereby incorporated by reference herein.

BACKGROUND

Technical Field

Embodiments of the present disclosure generally relate to a removable unit, such as a process cartridge and a developing device, that is removably installed in an image forming apparatus, and an image forming apparatus such as a copier, a printer, a facsimile machine, or a multifunction peripheral (MFP) having at least two functions of copying, printing, and facsimile transmission, and incorporating the removable unit.

Description of the Related Art

Among image forming apparatuses, such as copiers, printers, and the like, there are image forming apparatuses that include a removable unit such as a developing device in which electric power is supplied to powered components such as a developing roller, a toner layer regulator (a doctor blade), and the like included in the developing device from a power supply of the image forming apparatus.

SUMMARY

Embodiments of the present disclosure describe an improved removable unit that is removably installed in an apparatus. The removable unit includes a plurality of powered components, a power supply connector configured to electrically connect a power supply of the apparatus and the plurality of powered components. The power supply connector is configured to change a combination of respective voltages applied to the plurality of powered components.

BRIEF DESCRIPTION OF THE SEVERAL VIEWS OF THE DRAWINGS

A more complete appreciation of the disclosure and many of the attendant advantages thereof will be readily obtained as the same becomes better understood by reference to the following detailed description when considered in connection with the accompanying drawings, wherein.

Figure 1:
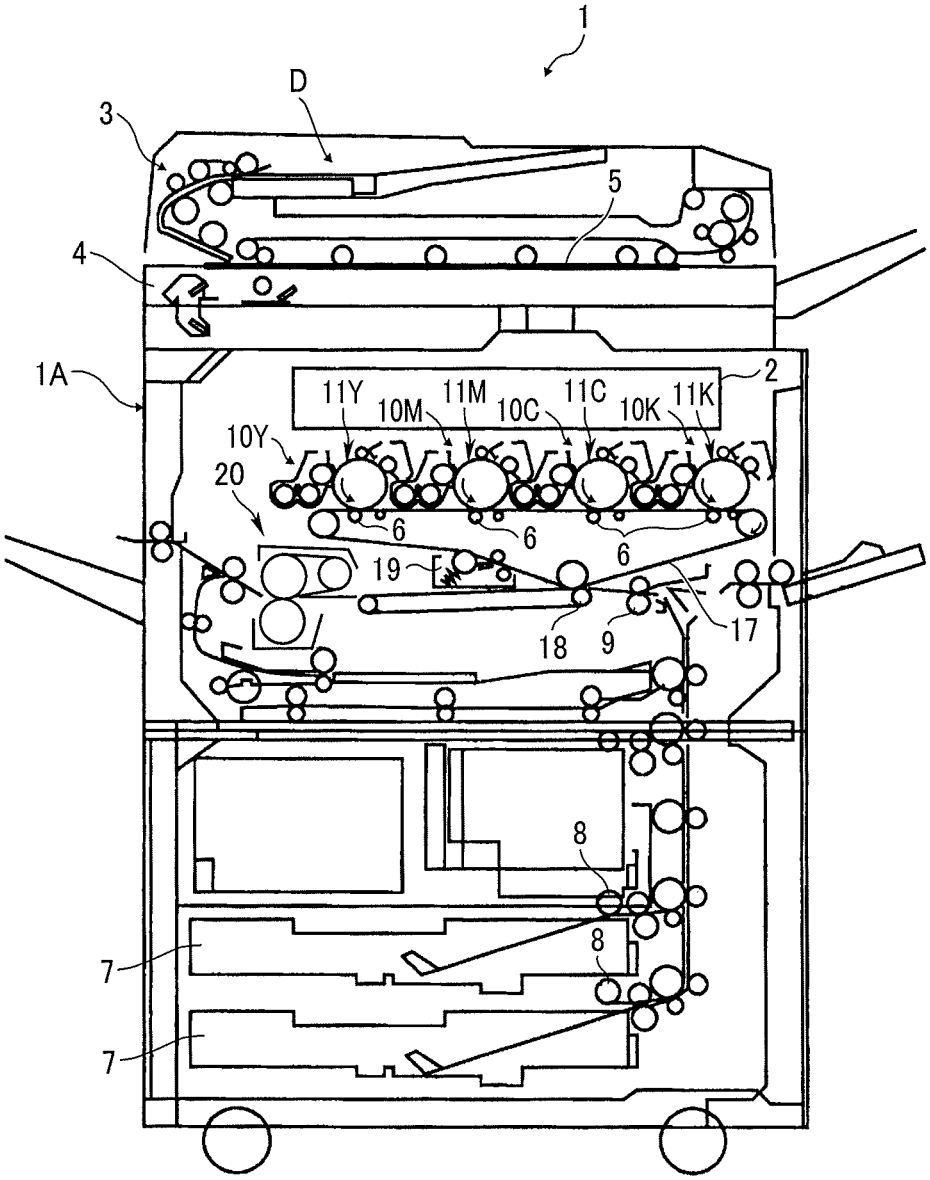
FIG. 1 is a schematic view illustrating a configuration of an image forming apparatus according to an embodiment of the present disclosure.

The accompanying drawings are intended to depict embodiments of the present disclosure and should not be interpreted to limit the scope thereof. The accompanying drawings are not to be considered as drawn to scale unless explicitly noted. In addition, identical or similar reference numerals designate identical or similar components throughout the several views.

DETAILED DESCRIPTION

Embodiments of the present disclosure are described in detail with reference to drawings. It is to be understood that identical or similar reference numerals are assigned to identical or corresponding components throughout the drawings, and redundant descriptions are omitted or simplified below as required.

In describing embodiments illustrated in the drawings, specific terminology is employed for the sake of clarity. However, the disclosure of this patent specification is not intended to be limited to the specific terminology so selected, and it is to be understood that each specific element includes all technical equivalents that have the same function, operate in a similar manner, and achieve a similar result.

As used herein, the singular forms "a", "an", and "the" are intended to include the plural forms as well, unless the context clearly indicates otherwise.

It is to be noted that the suffixes Y, M, C, and K attached to each reference numeral indicate only that components indicated thereby are used for forming yellow, magenta, cyan, and black images, respectively, and hereinafter may be omitted when color discrimination is not necessary.

Figure 2:
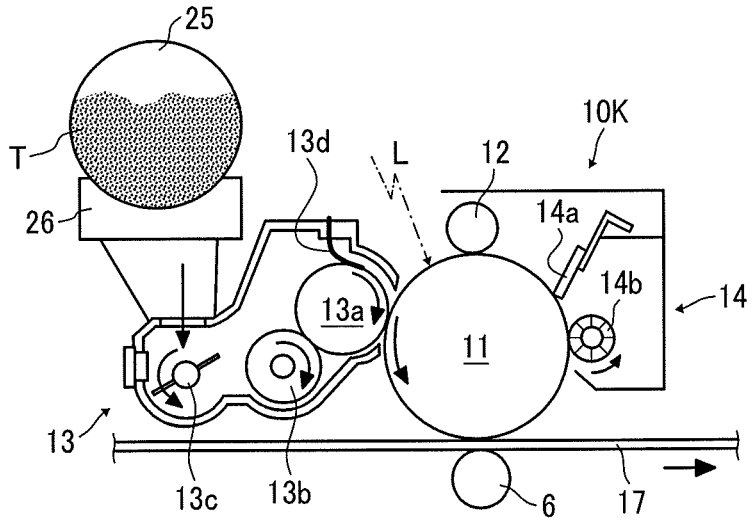
FIG. 2 is a schematic view of a process cartridge of the image forming apparatus illustrated in FIG. 1 and the vicinity thereof.

With reference to FIGS. 1 and 2, a configuration and operation of an image forming apparatus 1 is described below.

FIG. 1 is a schematic view illustrating a configuration of the image forming apparatus 1 according to the present embodiment. FIG. 2 is a cross-sectional view illustrating a configuration of a process cartridge 10K (i.e., an image forming unit) for black installed in the image forming apparatus 1 illustrated in FIG. 1.

It is to be noted that the process cartridges 10Y, 10M, 10C, and 10K serving as removable units have the same configuration except for the color of toner T used in image formation, and thus only the process cartridge 10K is illustrated as representative in FIG. 2 (and FIGS. 3 to 10 described later).

In FIG. 1, the image forming apparatus 1, which is a tandem color copier in the present embodiment, includes a writing device 2, a document conveyance device 3, a document reading device 4, a sheet feeding device 7, and a registration roller pair 9. The writing device 2 emit a laser beam based on input image data. The document conveyance device 3 conveys an original document D to the document reading device 4. The document reading device 4 reads image data of the original document D. The sheet feeding device 7 contains sheets such as paper sheets. The registration roller pair 9 adjusts the timing of conveyance of the sheet.

The image forming apparatus 1 also includes the process cartridges 10Y, 10M, 10C, and 10K as the removable units, an intermediate transfer belt 17, and primary transfer bias rollers 6. The process cartridges 10Y, 10M, 10C, and 10K form toner images of respective colors of yellow, magenta, cyan, and black on photoconductor drums 11Y, 11M, 11C, and 11K thereof (hereinafter, also collectively referred to as "photoconductor drums 11"). The primary transfer bias rollers 6 primarily transfer and superimpose the toner images formed on the respective photoconductor drums 11 onto the intermediate transfer belt 17, thereby forming a multicolor toner image.

The image forming apparatus 1 further includes a secondary transfer bias roller 18, a belt cleaning device 19, and a fixing device 20. The secondary transfer bias roller 18 secondarily transfers the multicolor toner image on the intermediate transfer belt 17 onto the sheet. The belt cleaning device 19 cleans the intermediate transfer belt 17. The fixing device 20 fixes the multicolor toner image (unfixed image) on the sheet.

A description is provided below of operation of the image forming apparatus 1 to form a normal color image.

Conveyance rollers of the document conveyance device 3 convey the original document D on a document table onto an exposure glass 5 of the document reading device 4. Then, the document reading device 4 optically reads the image data of the original document D set on the exposure glass 5.

The yellow, magenta, cyan, and black image data are sent to the writing device 2. The writing device 2 irradiates the photoconductor drums 11 of the corresponding process cartridges 10Y, 10M, 10C, and 10K with laser beams (exposure light) L based on the yellow, magenta, cyan, and black image data, respectively.

Meanwhile, the photoconductor drum 11 (see FIG. 2) in each of the four process cartridges 10Y, 10M, 10C, and 10K rotates in a predetermined direction (i.e., counterclockwise in FIG. 2). A charging roller 12 uniformly charges a surface of the photoconductor drum 11 at a position opposed to each other (a charging process). As a result, a charging potential is formed on the surface of the photoconductor drum 11. In the present embodiment, the charging potential on the photoconductor drum 11 is approximately −900 V. Subsequently, the surface of the photoconductor drum 11 thus charged reaches a position to receive the laser beam L.

The writing device 2 emits the laser beams L according to image data from four light sources. The respective laser beams L pass through different optical paths for components of yellow, magenta, cyan, and black (an exposure process).

The laser beam L for the yellow component is directed to the surface of the photoconductor drum 11Y as an image bearer that is the first from the left among the four photoconductor drums 11Y, 11M, 11C, and 11K in FIG. 1. At that time, a polygon mirror rotates at high speed to deflect the laser beam L for the yellow component in a direction of rotation axis of the photoconductor drum 11 (i.e., the main scanning direction) so that the laser beam L scans the photoconductor drum 11. Thus, an electrostatic latent image for yellow with an exposure potential of −50 to 100 V is formed on the photoconductor drum 11 charged by the charging roller 12.

Similarly, the laser beam L for the magenta component is directed to the surface of the photoconductor drum 11M that is the second from the left in FIG. 1, thus forming an electrostatic latent image for magenta thereon. The laser beam L for the cyan component is directed to the surface of the photoconductor drum 11C that is the third from the left in FIG. 1, thus forming an electrostatic latent image for cyan thereon. The laser beam L for the black component is directed to the surface of the photoconductor drum 11K that is the fourth from the left in FIG. 1, thus forming an electrostatic latent image for black thereon.

Then, the surface of the photoconductor drum 11 having the electrostatic latent image reaches a position opposite a developing roller 13*a* of the developing devices 13 (i.e., development nip). The developing device 13 supplies toner of each color onto the surface of the photoconductor drum 11 and develops the electrostatic latent image on the photoconductor drum 11 into a visible toner image (a development process).

Subsequently, the surface of the photoconductor drum 11 after the development process reaches a position facing the intermediate transfer belt 17 (i.e., a primary transfer nip). The primary transfer bias rollers 6 are disposed at the positions where the photoconductor drums 11 face the intermediate transfer belt 17 and in contact with an inner surface of the intermediate transfer belt 17, respectively. At the positions of the primary transfer bias rollers 6, the toner images on the photoconductor drums 11 are transferred and superimposed onto the intermediate transfer belt 17, forming the multicolor toner image thereon (a primary transfer process).

After the primary transfer process, the surface of the photoconductor drum 11 reaches a position opposite a cleaning device 14. At this position, a cleaning blade 14*a* and a cleaning brush roller 14*b* mechanically remove toner (i.e., untransferred toner) remaining on the photoconductor drum 11, and the removed toner is collected in the cleaning device 14 (a cleaning process).

Then, the surface of the photoconductor drum 11 passes through the discharger to complete a series of image forming processes performed on the photoconductor drum 11.

As described above, the multicolor toner image is formed on the intermediate transfer belt 17 by transferring and superimposing the respective single-color toner images formed on the photoconductor drums 11. Then, the intermediate transfer belt 17 carrying the multicolor toner image moves clockwise in FIG. 1 to reach a position opposite the secondary transfer bias roller 18 (i.e., a secondary transfer nip). The secondary transfer bias roller 18 transfers the multicolor toner image from the intermediate transfer belt 17 onto the sheet (a secondary transfer process).

After the secondary transfer process, the surface of the intermediate transfer belt 17 reaches a position opposite the belt cleaning device 19. The belt cleaning device 19 collects untransferred toner adhering to the intermediate transfer belt 17 to complete a sequence of transfer processes performed on the intermediate transfer belt 17.

The sheet is conveyed from one of sheet feeding devices 7 via a registration roller pair 9 to the secondary transfer nip between the intermediate transfer belt 17 and the secondary transfer bias roller 18.

More specifically, a sheet feeding roller 8 feeds the sheet from the sheet feeding device 7 that contains multiple sheets, and the sheet is then guided by a sheet guide to the registration roller pair 9 (i.e., timing roller pair). The sheet that has reached the registration roller pair 9 is conveyed toward the secondary transfer nip, timed to coincide with the multicolor toner image on the intermediate transfer belt 17.

Subsequently, the sheet carrying the multicolor image is guided to the fixing device by a conveyance belt. The fixing device 20 includes a fixing belt and a pressure roller pressing against each other. In a nip therebetween, the multicolor image (toner image) is fixed on the sheet.

After the fixing process, output rollers eject the sheet as an output image outside an apparatus body 1A of the image forming apparatus 1 to complete a sequence of image forming processes.

Figure 3:
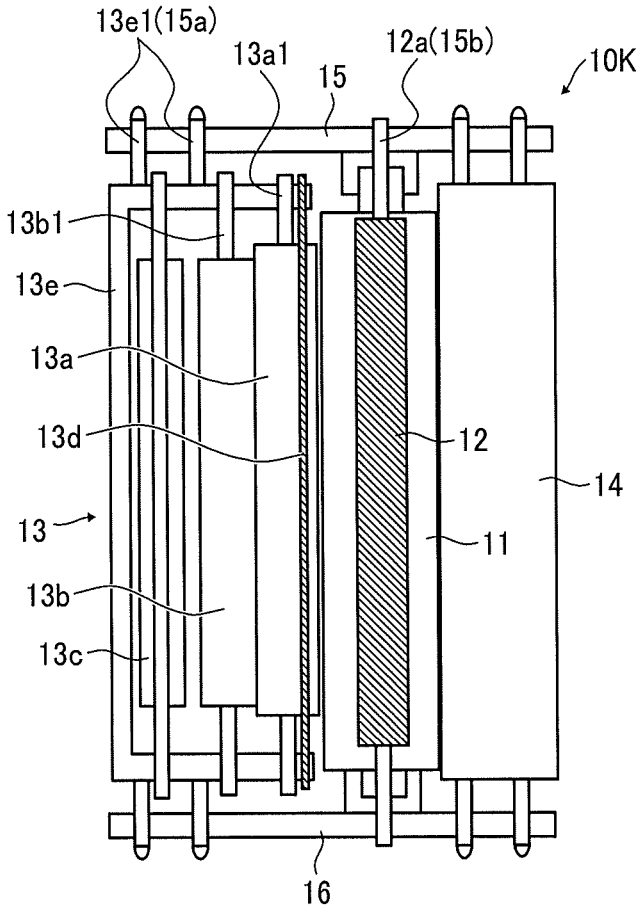
FIG. 3 is a schematic view of the process cartridge as viewed in a longitudinal direction of the process cartridge.

With reference to FIGS. 2 and 3, the process cartridge 10K as the removable unit is described in further detail below.

As illustrated in FIGS. 2 and 3, in the process cartridge 10K, the photoconductor drum 11, the charging roller 12 as a charging device, the developing device 13, and the cleaning device 14 are combined together as a single unit. The replaceable process cartridge 10K is removably installed in the apparatus body 1A of the image forming apparatus 1. The process cartridge 10K is detached from the apparatus body 1A to be and either replaced or repaired as appropriate.

The photoconductor drum 11 used in the present embodiment is an organic photoconductor charged to a negative polarity and includes a photosensitive layer formed on a drum-shaped conductive support.

For example, the photoconductor drum 11 is multilayered and includes a base coat serving as an insulation layer, the photosensitive layer, and a surface layer (i.e., a protection layer) sequentially overlying the conductive support as a substrate. The photosensitive layer includes a charge generation layer and a charge transport layer.

The photoconductor drum 11 is rotated counterclockwise in FIG. 2 by a main motor.

With reference to FIGS. 2 and 3, the charging roller 12 includes a roller shaft 12*a* made of metal (i.e., conductive material) and an elastic layer with moderate resistivity coating the roller shaft 12*a*. The charging roller 12 is disposed in contact with the photoconductor drum 11 (or opposed to the photoconductor drum 11 with a small gap). Receiving a predetermined voltage (i.e., a charging bias VD) from a power supply 60 (see FIG. 4), the charging roller 12 uniformly charges the surface of the photoconductor drum 11 opposed to the charging roller 12.

The developing device 13 includes the developing roller 13*a* as a developer bearer disposed in contact with (or opposed to) the photoconductor drum 11, a supply roller 13*b* disposed in sliding contact with the developing roller 13*a* to supply toner to the developing roller 13*a*, an agitator 13*c* configured to stir and convey toner in the developing device 13, and a doctor blade 13*d* disposed in contact with the developing roller 13*a*.

The developing roller 13*a* includes a roller shaft 13*a*1 made of metal (i.e., conductive material) and a rubber layer having conductivity overlying the roller shaft 13*a*1. The supply roller 13*b* includes a roller shaft 13*b*1 made of metal (i.e., conductive material) and an elastic layer having conductivity overlying the roller shaft 13*b*1. The agitator 13*c* includes a roller shaft and a blade attached to the roller shaft to stir toner. The doctor blade 13*d* is a thin plate made of metal (i.e., conductive material) having springiness. The developing device 13 contains toner T (one-component developer).

The developing roller 13*a*, the supply roller 13*b*, and the agitator 13*c* are driven to rotate in the direction indicated by arrows in FIG. 2 by the main motor. The agitator 13*c* stirs and mixes toner T in the developing device 13 with toner T supplied from a toner supply device via a toner supply inlet while conveying the mixed toner T toward the supply roller 13*b*. The toner supply device includes a toner bottle 25 and a toner hopper 26. The toner T carried on the supply roller 13*b* is triboelectrically charged by sliding contact with the developing roller 13*a*, and the toner T is carried on the developing roller 13*a*.

The toner T carried on the developing roller 13*a* reaches a position opposite the doctor blade 13*d*. The amount of the toner T on the developing roller 13*a* is thinned to a suitable amount by the doctor blade 13*d*, after which the toner T is carried to the development range opposite the photoconductor drum 11.

In the development range, the toner T on the developing roller 13*a* adheres to the electrostatic latent image formed on the surface of the photoconductor drum 11, thereby forming a desired toner image. Specifically, the toner T adheres to the electrostatic latent image by a development electric field formed by a potential difference (i.e., a developing potential) between a latent image potential (i.e., an exposure potential) of an image area irradiated with the laser beam L and a development bias VB applied to the developing roller 13*a* from the power supply 60. The development bias VB is approximately −150 V.

Figure 4:
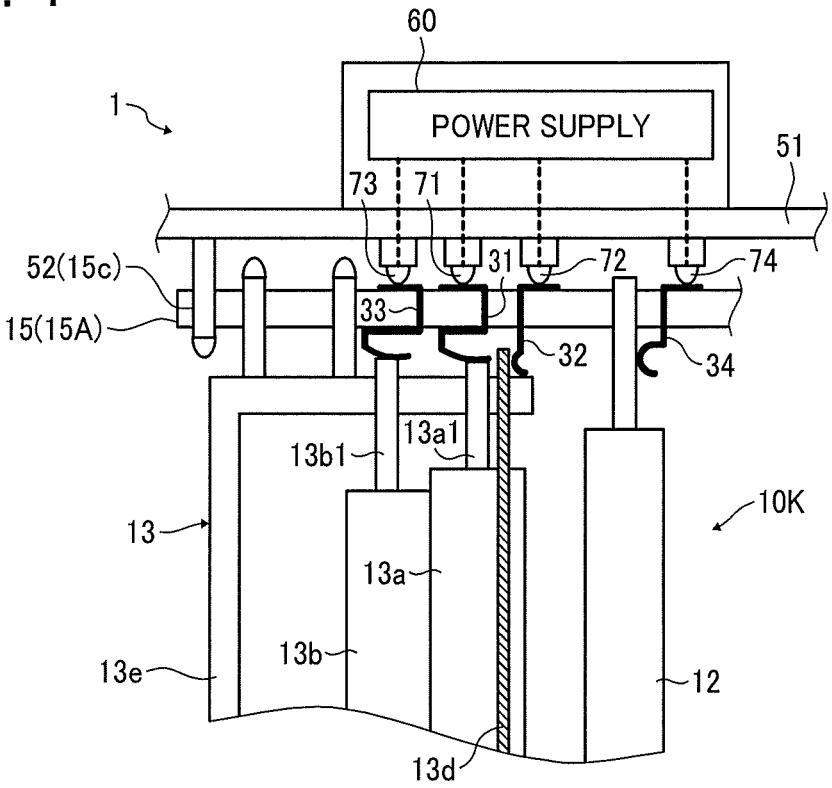
FIG. 4 is a schematic view illustrating a main part of the process cartridge installed in the image forming apparatus.

In addition to the developing roller 13*a*, predetermined voltages are applied to the supply roller 13*b* and the doctor blade 13*d* from the power supply 60 of the apparatus body 1A, respectively (see FIG. 4). Thus, the desired potential difference is formed between the developing roller 13*a* and the supply roller 13*b*, causing the toner T to move from the supply roller 13*b* to the developing roller 13*a*. Further, a desired potential difference is formed between the developing roller 13*a* and the doctor blade 13*d*, and the doctor blade 13*d* optimally thins the toner T on the developing roller 13*a*.

The toner supply device of the apparatus body 1A includes the replaceable toner bottle 25 and the toner hopper 26. The toner hopper 26 holds and drives the toner bottle 25 and supplies fresh toner T to the developing device 13. Each toner bottle 25 contains fresh toner T (black toner in FIG. 2). On an inner face of the toner bottle 25, a helical projection is disposed.

The fresh toner T contained in the toner bottle 25 is supplied through the toner supply inlet to the developing device 13 as the toner T existing in the developing device 13 is consumed. The consumption of the toner T in the developing device 13 is detected either directly or indirectly using a piezoelectric sensor disposed in the developing device 13.

With reference to FIG. 2, the cleaning device 14 includes the cleaning blade 14*a* in contact with the photoconductor drum 11 to clean the surface of the photoconductor drum 11 and the cleaning brush roller 14*b* that rotates in a predetermined direction (counterclockwise in FIG. 2) while contacting the surface of the photoconductor drum 11 to clean the surface of the photoconductor drum 11.

Next, the configuration and operation of the process cartridge 10K of the image forming apparatus 1 according to the present embodiment are described in further detail below.

As described above with reference to FIG. 2, the process cartridge 10K is a removable unit that is removably installed in the apparatus body 1A and includes the photoconductor drum 11, the developing device 13, the charging roller 12, and the cleaning device 14.

The process cartridge 10K as the removable unit is installed in and removed from the apparatus body 1A in a direction of a rotation axis of the photoconductor drum 11 (or the developing roller 13*a*), that is, the direction perpendicular to the surface of the paper on which FIG. 2 is drawn or the top and bottom direction in FIGS. 3 and 4.

Specifically, with reference to FIGS. 2, 3, and 4, the process cartridge 10K as the removable unit is divided into four subunits 11 to 14: the photoconductor drum 11, the charging roller 12, the developing device 13, and the cleaning device 14. Both ends in the longitudinal direction (the direction of rotation axis) of the four subunits 11 to 14 are respectively held by the covers (side plates) 15 and 16, thereby constituting the process cartridge 10K.

Specifically, a positioning pin 13*e*1 attached to a development case 13*e* of the developing device 13 is inserted into a positioning hole 15*a* of a cover 15, the roller shaft 12*a* of the charging roller 12 is inserted into a hole 15*b* of the cover 15 via a bearing, a shaft of the photoconductor drum 11 is inserted into a bearing of the cover 15, and the positioning pin attached to the cleaning device 14 is inserted into a positioning hole of the cover 15. A cover 16 holds the developing device 13, the cleaning device 14, the photoconductor drum 11, and the charging roller 12 in the same manner. Then, the covers 15 and 16 are screwed to the development case 13*e* and the cleaning device 14 to construct the process cartridge 10K. That is, the covers 15 and 16 are detachable (replaceable) from the process cartridge 10K (the removable unit).

Note that, with the process cartridge 10K, the configuration of the subunits and the method of holding the subunits is not limited to the above-described embodiments.

As the process cartridge 10K constructed as described above is installed in the apparatus body 1A, as illustrated in FIG. 4, a positioning pin 52 attached to a side plate 51 of the apparatus body 1A is inserted into a positioning hole 15*c* of the cover 15 of the process cartridge 10K. The cover 16 on the opposite side of the process cartridge 10K is held by the apparatus body 1A in the same manner. Thus, the process cartridge 10K is positioned relative to the apparatus body 1A and supported by the apparatus body 1A. At that time, the power supply terminals 71 to 74 attached to the side plate 51 of the apparatus body 1A contact electrical conductors 31 to 34 attached to the cover 15 of the process cartridge 10K. Accordingly, the power supply 60 of the apparatus body 1A can supply electric power to the process cartridge 10K, which is described in detail later.

The method of supporting the process cartridge 10K by the apparatus body 1A is not limited to the above-described embodiments.

Here, the process cartridge 10K as the removable unit includes a plurality of powered components to which the power supply 60 of the apparatus body 1A supplies electric power, such as the developing roller 13*a*, the supply roller 13*b*, the doctor blade 13*d*, and the charging roller 12 (hereinafter, also collectively referred to as "powered components 12, 13*a*, 13*b*, and 13*d*"). That is, desired voltages (biases) are applied to the developing roller 13*a*, the supply roller 13*b*, the doctor blade 13*d*, and the charging roller 12 by the power supply 60, respectively.

In the present embodiment, the replaceable cover 15 is detachably attached to the process cartridge 10K. As illustrated in FIG. 4, when the process cartridge 10K is installed in the apparatus body 1A, the cover 15 serves as a power connector to electrically connect the power supply 60 and the plurality of powered components (i.e., the charging roller 12, the developing roller 13*a*, the supply roller 13*b*, and the doctor blade 13*d*.

Figure 5A:
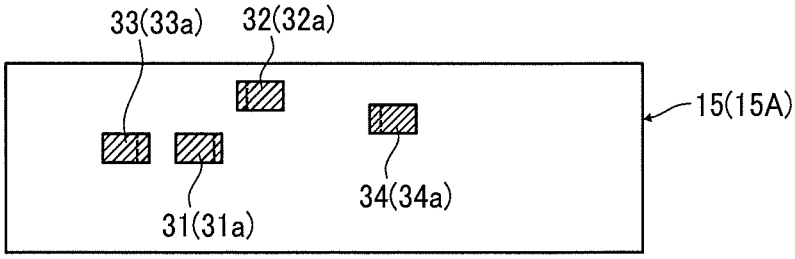
FIG. 5A is a schematic view illustrating a front surface of a first cover of the process cartridge.
Figure 5B:
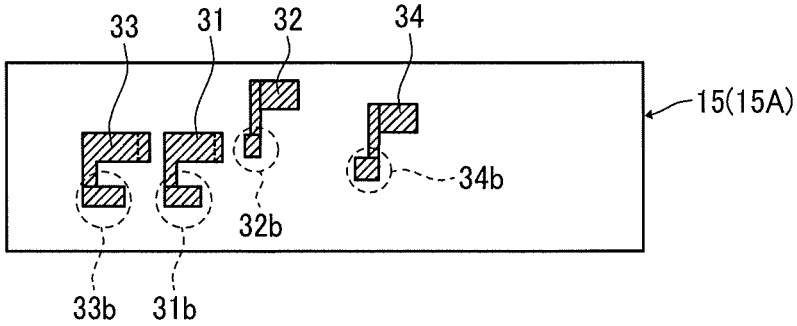
FIG. 5B is a schematic view illustrating a rear surface of the first cover of the process cartridge.

More specifically, as illustrated in FIGS. 4, 5A, and 5B, a plurality of electrical conductors 31 to 34 (conductive plates) are attached to the cover 15 disposed on the rear side of the process cartridge 10K in the direction of installation of the process cartridge 10K in the apparatus body 1A. The electrical conductors 31 to 34 are plate-shaped members having springiness and made of a conductive material such as stainless steel or phosphor bronze. The electrical conductors 31 to 34 are bent at a plurality of portions. The electrical conductors 31 to 34 include first connection portions 31*a* to 34*a* and second connection portions 31*b* to 34*b*, respectively. When the process cartridge 10K is installed in the apparatus body 1A, the first connection portions 31*a* to 34*a* are connected to a plurality of power supply terminals 71 to 74 of the power supply 60, respectively, and the second connection portions 31*b* to 34*b* are connected to the plurality of powered components: the developing roller 13*a*, the doctor blade 13*d*, the supply roller 13*b*, and the charging roller 12, respectively. As illustrated in FIG. 5A, the first connection portions 31*a* to 34*a* face the outside of the process cartridge 10K (i.e., the side where the power supply 60 is disposed). On the other hand, as illustrated in FIG. 5B, the second connection portions 31*b* to 34*b* face the inside of the process cartridge 10K (i.e., the side where the powered components 12, 13*a*, 13*b*, and 13*d* are disposed).

Figure 8A:
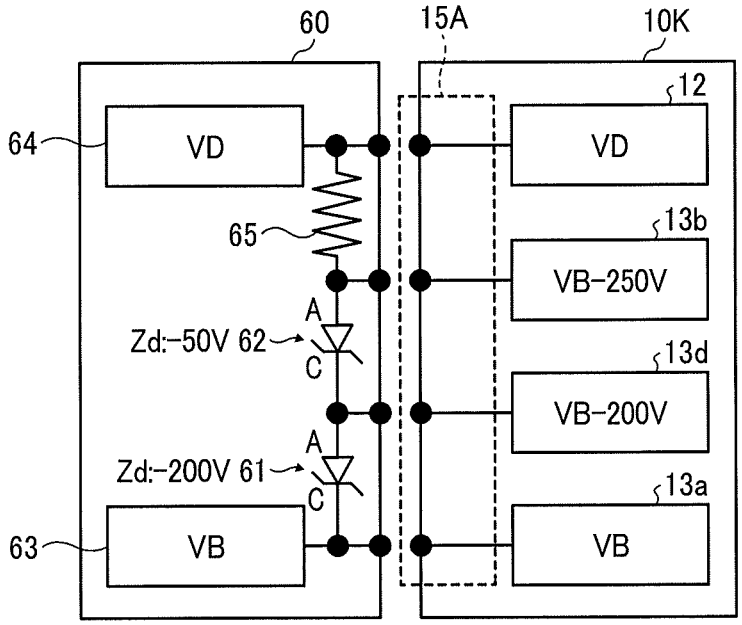
FIGS. 8A to 8E are block diagrams illustrating circuits from a power supply of the image forming apparatus to the process cartridge under different bias conditions.

Specifically, with reference to FIG. 8A in addition to FIGS. 4, 5A, and 5B, the first connection portion 31*a* of the first electrical conductor 31 connected to the first power supply terminal 71 is disposed on a front surface of the cover 15, and the second connection portion 31*b* of the first electrical conductor 31 connected to the roller shaft 13*a*1 of the developing roller 13*a* is disposed on a rear surface of the cover 15.

The first connection portion 32*a* of the second electrical conductor 32 connected to the second power supply terminal 72 is disposed on the front surface of the cover 15, and the second connection portion 32*b* of the second electrical conductor 32 connected to the doctor blade 13*d* is disposed on the rear surface of the cover 15.

The first connection portion 33*a* of the third electrical conductor 33 connected to the third power supply terminal 73 is disposed on the front surface of the cover 15, and the second connection portion 33*b* of the third electrical conductor 33 connected to the roller shaft 13*b*1 of the supply roller 13*b* is disposed on the rear surface of the cover 15.

The first connection portion 34*a* of the fourth electrical conductor 34 connected to the fourth power supply terminal 74 is disposed on the front surface of the cover 15, and the second connection portion 34*b* of the fourth electrical conductor 34 connected to the charging roller 12 is disposed on the rear surface of the cover 15.

Zener diodes 41 and 42 to be described later are not disposed in the first cover 15A illustrated in FIGS. 4, 5A, 5B, and 8A.

In the present embodiment, the cover 15 as the power supply connector is configured to change a combination of voltages applied to the plurality of powered components 12, 13*a*, 13*b* and 13*d*. Hereinafter, the combination of voltages is referred to as "bias condition" as appropriate.

Specifically, the cover 15 as the power supply connector can include the Zener diodes 41 and 42 (see FIGS. 6 to 10) in a circuit of at least one of the plurality of electrical conductors 31 to 34.

Figure 6:
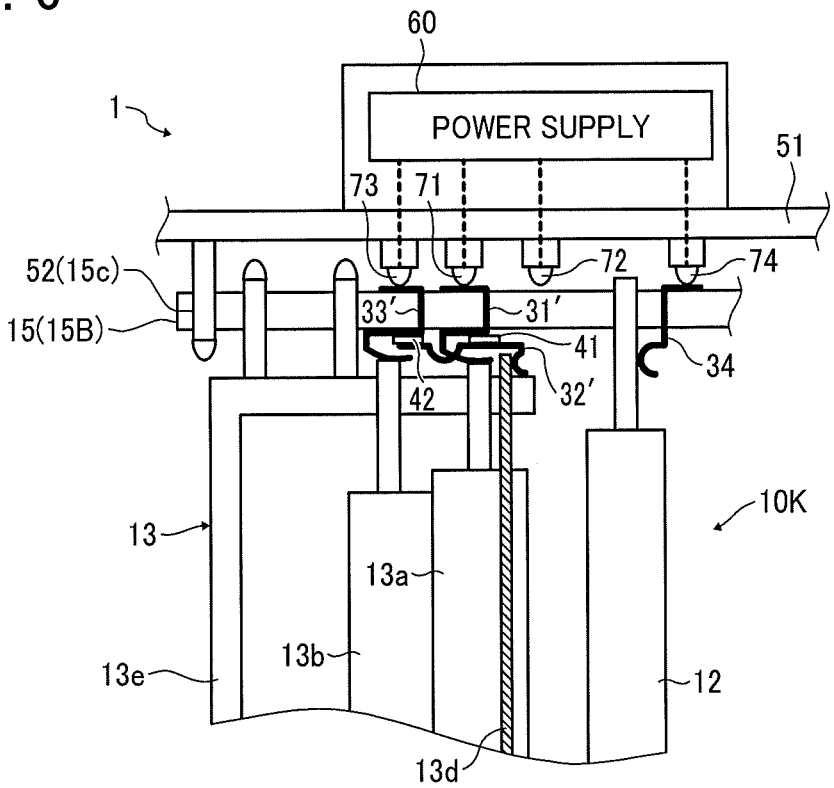
FIG. 6 is a schematic view illustrating a second cover of the process cartridge installed in the image forming apparatus and the vicinity thereof.
Figure 7A:
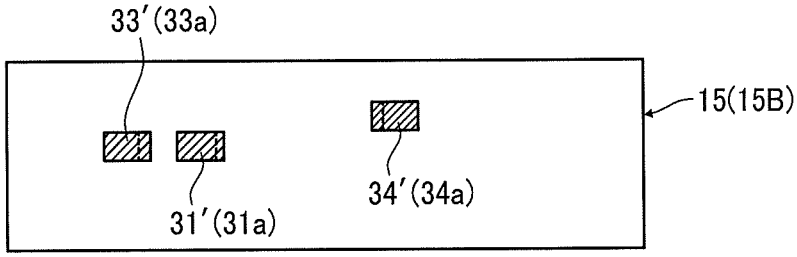
FIG. 7A is a schematic view illustrating a front surface of the second cover.
Figure 7B:
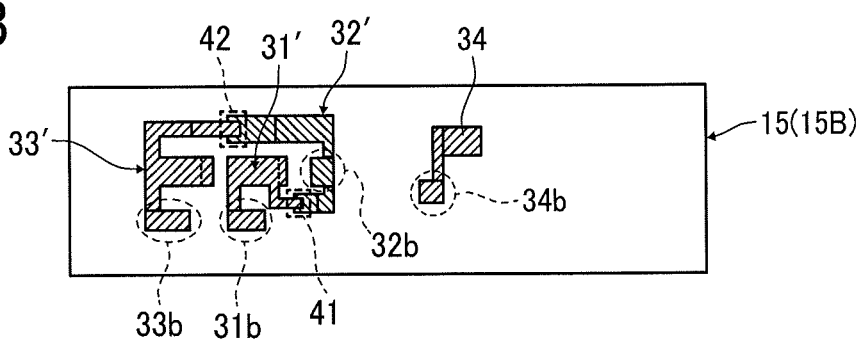
FIG. 7B is a schematic view illustrating a rear surface of the second cover.

Specifically, the cover 15 illustrated in FIGS. 6, 7A, and 7B attached to the process cartridge 10K is a second cover 15B in which the Zener diodes 41 and 42 are disposed in the circuit of at least one of the electrical conductors 31 to 34.

Figure 8B:
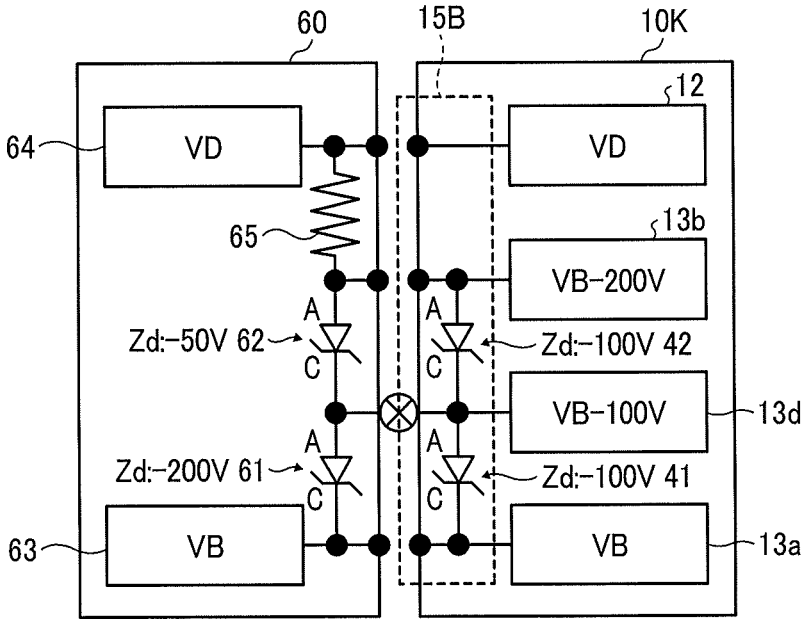

With reference to FIG. 8B in addition to FIGS. 6, 7A, and 7B, the cover 15 (i.e., the second cover 15B) includes a first electrical conductor 31', a second electrical conductor 32', and a third electrical conductor 33'.

The first connection portion 31*a* of the first electrical conductor 31' connected to the first power supply terminal 71 is disposed on the front surface of the cover 15, and the second connection portion 31*b* of the first electrical conductor 31' connected to the roller shaft 13*a*1 of the developing roller 13*a* is disposed on the rear surface of the cover 15. Further, the first electrical conductor 31' is connected to the second electrical conductor 32' via the first Zener diode 41 on the rear surface of the cover 15.

The first connection portion 33*a* of the third electrical conductor 33' connected to the third power supply terminal 73 is disposed on the front surface of the cover 15, and the second connection portion 33*b* of the third electrical conductor 33' connected to the roller shaft 13*b*1 of the supply roller 13*b* is disposed on the rear surface of the cover 15. Further, the third electrical conductor 33' is connected to the second electrical conductor 32' via the second Zener diode 42 on the rear surface of the cover 15.

The second electrical conductor 32' is not directly connected to any of the power supply terminals 71 to 74 including the second power supply terminal 72. The second connection portion 32*b* of the second electrical conductor 32' connected to the doctor blade 13*d* is disposed on the rear surface of the cover 15. Further, the second electrical conductor 32' is connected to the first electrical conductor 31' via the first Zener diode 41 and the third electrical conductor 33' via the second Zener diode 42.

The first connection portion 34*a* of the fourth electrical conductor 34 connected to the fourth power supply terminal 74 is disposed on the front surface of the cover 15, and the second connection portion 34*b* of the fourth electrical conductor 34 connected to the charging roller 12 is disposed on the rear surface of the cover 15.

As described above, in the second cover 15B, the plurality of electrical conductors 31' to 33' and 34 and the two Zener diodes 41 and 42 form the plurality of circuits.

In the process cartridge 10K as the removable unit according to the present embodiment, at least two of the first cover 15A, the second cover 15B, and a third cover (or a plurality of third covers) are replaceable as the cover 15 of the process cartridge 10K. The Zener diodes 41 and 42 are not disposed in the first cover 15A (see FIGS. 4, 5A, 5B, and 8A). The second cover 15B includes the Zener diodes 41 and 42 provided with at least one of the plurality of electrical conductors 31' to 33' and 34 (see FIGS. 6, 7A, 7B, and 8B). The third covers 15C, 15D, and 15E include at least one of the Zener diodes 41 and 42 that have Zener voltages Zd different from the second cover 15B, provided with at least one of the plurality of electrical conductors 31' to 33' and 34 (see FIGS. 8C to 8E).

That is, according to the present embodiment, main parts of the process cartridge 10K, such as the subunits 11 to 14 (i.e., the photoconductor drum 11, the charging roller 12, the developing device 13, and the cleaning device 14), are standardized. As only the cover including the electrical conductors 31 to 34 (or 31' to 33' and 34) is replaced with one selected among the plurality of covers 15A to 15E, the bias condition (i.e., the combination of voltages applied to the plurality of powered components 12, 13*a*, 13*b*, and 13*d*) can be changed even if the power supply 60 of the apparatus body 1A is used as it is.

More specifically, as illustrated in FIGS. 8A to 8E, the power supply 60 of the apparatus body 1A includes an electric circuit including a high voltage power supply unit 63 for outputting the developing bias VB, a high voltage power supply unit 64 for outputting the charging bias VD, a resistor 65, the first Zener diode 61 having the Zener voltage Zd of −200 V, and the second Zener diode 62 having the Zener voltage Zd of −50 V. In FIGS. 8A to 8E, black circles located on the outline of the power supply 60 represent the power supply terminals 71 to 74, and the black circles located on the outline of the process cartridge 10K represent the connection portions 31*a* to 34*a*. In FIGS. 8A to 8E, the characters, such as "VD" and "VB" in the rectangles representing the high voltage power supply units 63 and 64 indicate voltages to output, and the characters, such as "VD", "VB −250 V", and the like in the rectangles representing the powered components 12, 13*a*, 13*b*, and 13*d* indicate voltages to be applied.

When the process cartridge 10K provided with the first cover 15A without Zener diode illustrated in FIG. 8A is installed in the apparatus body 1A, the connection portions 31*a* to 34*a* are connected to the power supply terminals 71 to 74, respectively. As a result, the developing bias VB is applied to the developing roller 13*a*, the voltage (VB −200 V) dropped by the Zener voltage Zd of the first Zener diode 61 of the power supply 60 is applied to the doctor blade 13*d*, and the voltage (VB −250 V) dropped by the total of the Zener voltages Zd of the first and second Zener diodes 61 and 62 of the power supply 60 is applied to the supply roller 13*b*. The charging bias VD is applied to the charging roller 12.

On the other hand, the second cover 15B illustrated in FIG. 8B includes the first Zener diode 41 having the Zener voltage Zd of −100 V and the second Zener diode 42 having the Zener voltage Zd of −100 V. When the process cartridge 10K provided with the second cover 15B illustrated in FIG. 8B is installed in the apparatus body 1A, the connection portions 31*a*, 33*a*, and 34*a* are connected to the power supply terminals 71, 73, and 74, respectively. As illustrated by the cross mark in FIG. 8B, the power supply terminal 72 is not connected to the second electrical conductor 32'. As a result, the developing bias VB is applied to the developing roller 13*a*, the voltage (VB−100 V) dropped by the Zener voltage Zd of the first Zener diode 41 of the second cover 15B is applied to the doctor blade 13*d*, and the voltage (VB−200 V) dropped by the total of the Zener voltages Zd of the first and second Zener diodes 41 and 42 of the second cover 15B is applied to the supply roller 13*b*. The charging bias VD is applied to the charging roller 12.

As described above, the sum of the Zener voltages Zd of the one or more Zener diodes 41 and 42 attached to the second cover 15B is smaller than the sum of the Zener voltages Zd of the one or more Zener diodes 61 and 62 attached to the electric circuit of the power supply 60 of the apparatus body 1A. With this configuration, electricity flows to the Zener diodes 41 and 42 of the second cover 15B, not to the Zener diodes 61 and 62 of the power supply 60, thereby generating voltage drops due to the Zener diodes 41 and 42.

Figure 8C:
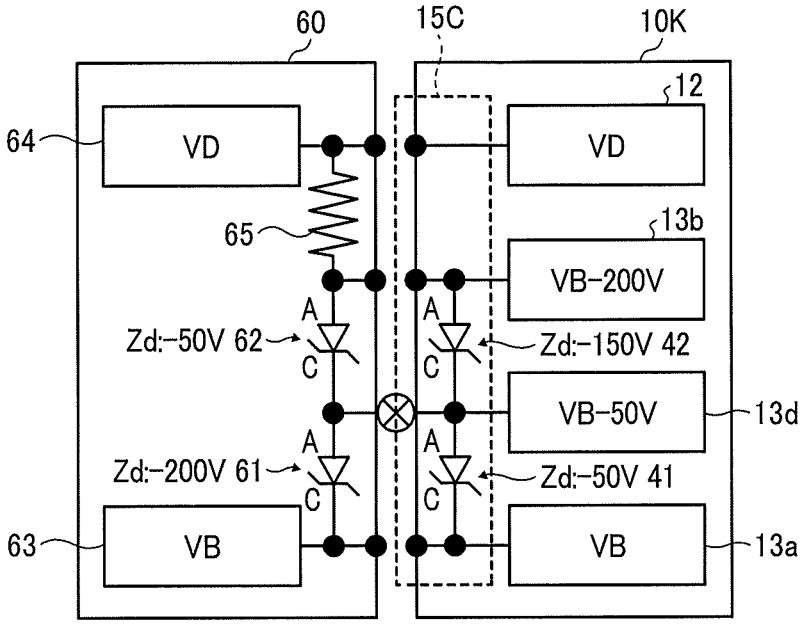

Further, the third cover 15C illustrated in FIG. 8C includes the first Zener diode 41 having the Zener voltage Zd of −50 V and the second Zener diode 42 having the Zener voltage Zd of −150 V. When the process cartridge 10K provided with the third cover 15C illustrated in FIG. 8C is installed in the apparatus body 1A, the connection portions 31*a*, 33*a*, and 34*a* are connected to the power supply terminals 71, 73, and 74, respectively. As illustrated by the cross mark in FIG. 8C, the power supply terminal 72 is not connected to the second electrical conductor 32'. As a result, the developing bias VB is applied to the developing roller 13*a*, the voltage (VB−50 V) dropped by the Zener voltage Zd of the first Zener diode 41 of the third cover 15C is applied to the doctor blade 13*d*, and the voltage (VB−200 V) dropped by the total of the Zener voltages Zd of the first and second Zener diodes 41 and 42 of the third cover 15C is applied to the supply roller 13*b*. The charging bias VD is applied to the charging roller 12. Similarly to the case of the second cover 15B, the sum of the Zener voltages Zd of the Zener diodes 41 and 42 attached to the third cover 15C is smaller than the sum of the Zener voltages Zd of the Zener diodes 61 and 62 of the power supply 60 of the apparatus body 1A.

Figure 8D:
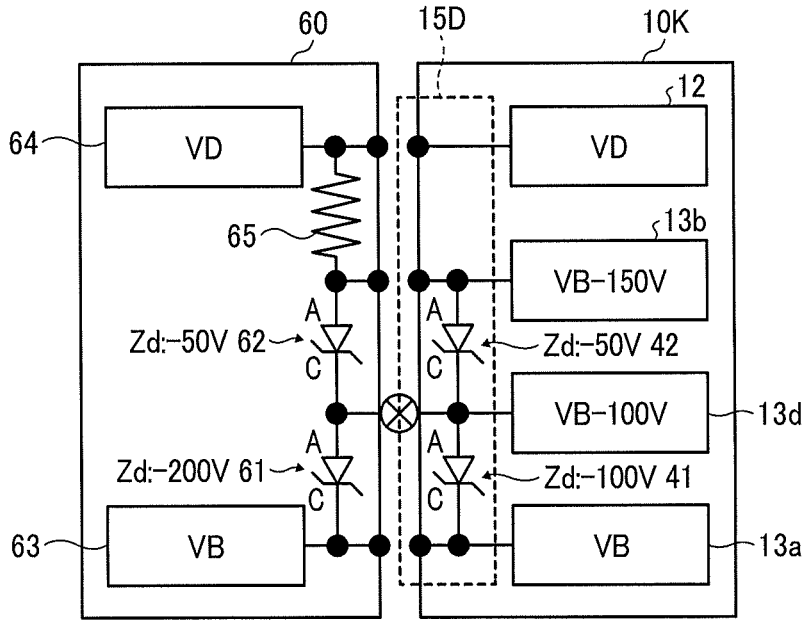

Further, the third cover 15D illustrated in FIG. 8D includes the first Zener diode 41 having the Zener voltage Zd of −100 V and the second Zener diode 42 having the Zener voltage Zd of −50 V. When the process cartridge 10K provided with the third cover 15D illustrated in FIG. 8D is installed in the apparatus body 1A, the connection portions 31*a*, 33*a*, and 34*a* are connected to the power supply terminals 71, 73, and 74, respectively. As illustrated by the cross mark in FIG. 8D, the power supply terminal 72 is not connected to the second electrical conductor 32'. As a result, the developing bias VB is applied to the developing roller 13*a*, the voltage (VB−100 V) dropped by the Zener voltage Zd of the first Zener diode 41 of the third cover 15D is applied to the doctor blade 13*d*, and the voltage (VB−150 V) dropped by the total of the Zener voltages Zd of the first and second Zener diodes 41 and 42 of the third cover 15D is applied to the supply roller 13*b*. The charging bias VD is applied to the charging roller 12. Also in this case, the sum of the Zener voltages Zd of the Zener diodes 41 and 42 attached to the third cover 15D is smaller than the sum of the Zener voltages Zd of the Zener diodes 61 and 62 of the power supply 60 of the apparatus body 1A.

Figure 8E:
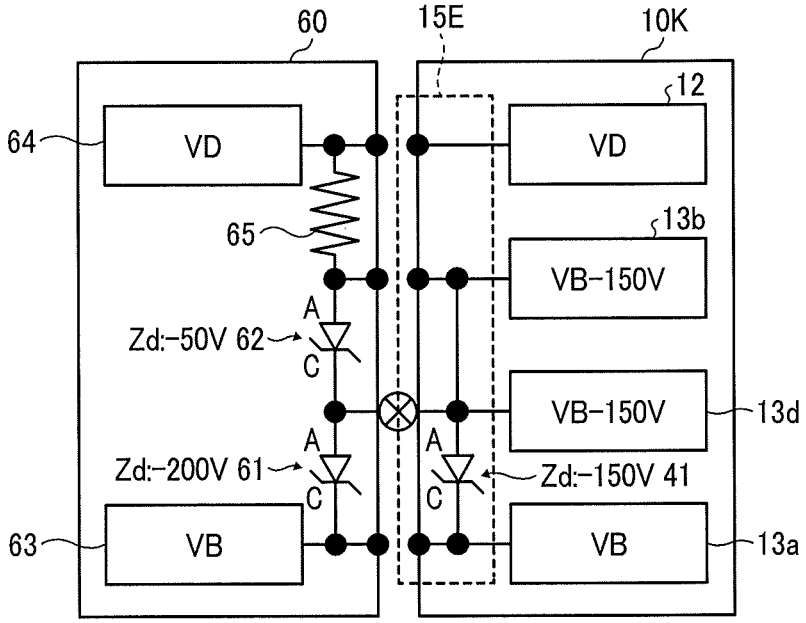

Further, the third cover 15E illustrated in FIG. 8E includes the first Zener diode 41 having the Zener voltage Zd of −150 V. When the process cartridge 10K provided with the third cover 15E illustrated in FIG. 8E is installed in the apparatus body 1A, the connection portions 31*a*, 33*a*, and 34*a* are connected to the power supply terminals 71, 73, and 74, respectively. As illustrated by the cross mark in FIG. 8E, the power supply terminal 72 is not connected to the second electrical conductor 32'. As a result, the developing bias VB is applied to the developing roller 13*a*, and the voltage (VB−150 V) dropped by the Zener voltage Zd of the first Zener diode 41 of the third cover 15E is applied to the doctor blade 13*d* and also to the supply roller 13*b*. The charging bias VD is applied to the charging roller 12. Also in this case, the Zener voltages Zd of the Zener diodes 41 attached to the third cover 15E is smaller than the sum of the Zener voltages Zd of the Zener diodes 61 and 62 of the power supply 60 of the apparatus body 1A.

As described above, in the present embodiment, the cover 15 as the power supply connector is detachably attached to the process cartridge 10K, and the voltage drops of the Zener diodes 41 and 42 are combined, thereby changing the bias condition.

That is, according to the present embodiment, the bias condition of the process cartridge 10K can be changed without changing or replacing the power supply 60 of the apparatus body 1A with another unit or without changing the configuration of the main parts of the process cartridge 10K. In other words, the power supply 60 of the apparatus body 1A can be standardized, and the main parts of a plurality of process cartridges 10K having different bias conditions can be standardized.

An example case in which the bias condition (i.e., the combination of voltage applied to the powered components 12, 13*a*, 13*b*, and 13*d*) is changed is when the specification of toner T or the developing roller 13*a* in the developing device 13 is changed with respect to the process cartridge 10K that has been installed and used in the apparatus body 1A in the market. Another example case is when the process cartridges 10Y, 10M, 10C and 10K of a plurality of colors are installed in the apparatus body 1A and fine adjustment of the bias condition is required for each color.

According to the present embodiment, when the bias condition (i.e., the combination of voltage applied to the powered components 12, 13*a*, 13*b*, and 13*d*) is changed, the power supply 60 of the apparatus body 1A does not need to be changed, thereby not taking time and cost.

Note that, the process cartridge 10K illustrated in FIGS. 8A to 8E can be remodeled into each configuration by replacing only the cover 15, or each process cartridge 10K having a different cover 15 can be prepared in advance.

Figure 9A:
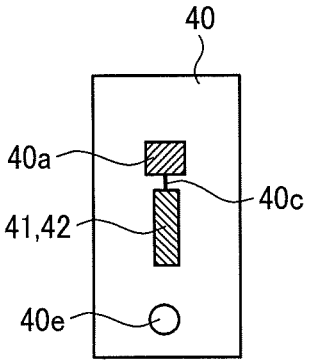
FIG. 9A is a front view of a substrate on which a Zener diode is disposed.
Figure 9B:
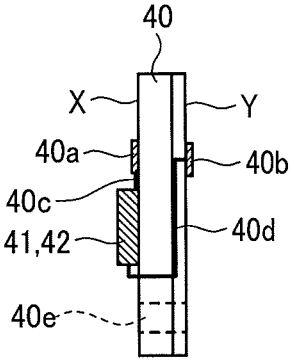
FIG. 9B is a side view of the substrate on which the Zener diode is disposed.
Figure 10:
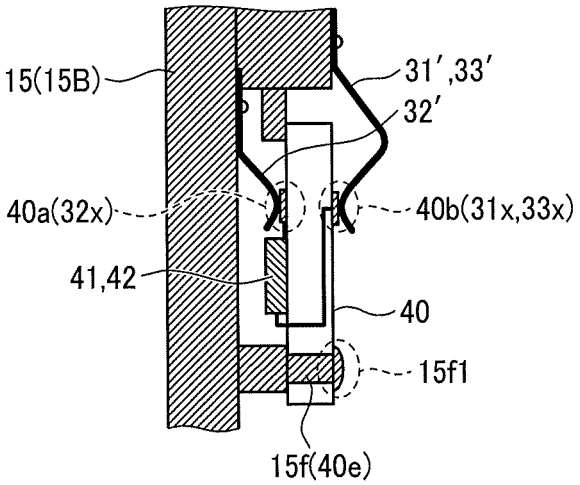
FIG. 10 is a schematic view illustrating the substrate in FIGS. 9A and 9B installed in the second cover.

In the cover 15 according to the present embodiment, as illustrated in FIGS. 9A, 9B, and 10, the Zener diodes 41 and 42 are chips attached to a substrate 40, that is, printed circuit board (PCB).

At least one of the circuits includes two electrical conductors 31' and 32' (or 32' and 33') having plate-shaped (or linear) elastic deformable portions 31*x* to 33*x*. The elastic deformable portions 31*x* to 33*x* are contact portions having springiness. The elastic deformable portion 32*x* (33*x*) of the electrical conductor 32' (33') elastically deforms to contact the first terminal 40*a* (40*b*) of the substrate 40 connected to an anode of the Zener diode 41 (42). On the other hand, the elastic deformable portion 31*x* (32*x*) of the electrical conductor 31' (32') elastically deforms to contact the second terminal 40*b* (40*a*) of the substrate 40 connected to a cathode of the Zener diode 41 (42).

In particular, in the present embodiment, the first terminal 40*a* and the second terminal 40*b* are disposed on different surfaces of the substrate 40, and the substrate 40 is interposed between the elastic deformable portion 32*x* of the electrical conductor 32' and the elastic deformable portion 31*x* of the electrical conductor 31'. The first terminal 40*a* is connected to the anode of the Zener diode 41 via conducting wire 40*c*, and the second terminal 40*b* is connected to the cathode of the Zener diode 41 via conducting wire 40*d*, which is distributed from the front surface to the back surface of the substrate 40.

As described above, since two flat springs (i.e., the elastic deformable portions 31*x* and 32*x*) sandwich the substrate 40 to form the circuit, even when the Zener diode 41 is disposed in the circuit, the contact of the Zener diode 41 with the two flat springs is reliably maintained, and the electric circuit can become compact.

Further, with reference to FIG. 10, the cover 15 includes a projection 15*f* made of a thermoplastic resin. In the present embodiment, the entire cover 15 is made of a thermoplastic resin. With reference to FIGS. 9A and 9B, the substrate 40 has a hole 40*e*.

With reference to FIG. 10, the projection is inserted into the hole 40*e* of the substrate 40, and then, the tip of the projection 15*f* is thermally melted to form a thermal caulking portion 15*f*1, thereby securing the substrate 40 to the cover 15. That is, the substrate 40 is secured by the thermal caulking portion 15*f*1 while being held on the seat of the cover 15.

With this configuration, even if the space is not enough to secure the substrate 40 by using screws, rivets, retaining rings, and the like, the substrate 40 can be secured in the narrow space of the cover 15.

As described above, a removable unit such as the process cartridge 10K according to the above embodiments includes a plurality of powered components, such as the charging roller 12, the developing roller 13*a*, the supply roller 13*b*, and the doctor blade 13*d*, and a power supply connector such as the cover 15. The power supply connector connects the power supply 60 of the apparatus body 1A of the image forming apparatus 1 to the plurality of powered components 12, 13*a*, 13*b*, and 13*d* when the removable unit is installed in the apparatus body 1A. The cover 15 is configured to change the combination of the respective voltages applied to the plurality of powered components 12, 13*a*, 13*b*, and 13*d*.

Thus, the bias conditions of the powered components 12, 13*a*, 13*b*, and 13*d* in the process cartridge 10K can be easily changed without changing the power supply 60 of the apparatus body 1A.

In the above-described embodiments, the photoconductor drum 11, the charging roller 12, the developing device 13, and the cleaning device 14 constitute the process cartridge 10K as a single unit, thereby making the image forming unit (i.e., the process cartridge 10K) compact and facilitating maintenance work. However, the configuration of the process cartridge 10K are not limited to the above-described embodiments, but various types of configurations can be used.

In such configurations, similar effects to the embodiments described above are also attained.

It is to be noted that the term "process cartridge" used in the present disclosure means a removable device (a removable unit) including a photoconductor drum as an image bearer and at least one of a charger to charge the photoconductor drum, a developing device to develop latent images on the photoconductor drum, and a cleaning device to clean the photoconductor drum that are united together, and is designed to be removably installed as a united part in the apparatus body of the image forming apparatus.

In the above-described embodiments, the present disclosure is applied to the process cartridge 10K as a removable unit. Alternatively, the present disclosure can be applied to any removable unit that is installable in and removable from the apparatus body 1A and includes a plurality of powered components. In particular, the present disclosure may be applied to the developing device 13 that is independently installed in the apparatus body 1A.

Further, the shape, the arrangement, the combination, and the like of the electrical conductors 31 to 34 and 31' to 33' of the cover 15 as the power connector are not limited to those in the above-described embodiments.

Additionally, a two-component developing device can be used as well as the one-component developing device 13 in the above-described embodiments.

In such configurations, effects similar to those of the above-described embodiments are also attained.

According to the present disclosure, a removable unit and an image forming apparatus can be provided that can reliably change a bias condition of a powered component of the removable unit without changing the power supply of the image forming apparatus.

The above-described embodiments are illustrative and do not limit the present disclosure. Thus, numerous additional modifications and variations are possible in light of the above teachings. It is therefore to be understood that within the scope of the present disclosure, the present disclosure may be practiced otherwise than as specifically described herein. The number, position, and shape of the components described above are not limited to those embodiments described above. Desirable number, position, and shape can be determined to perform the present disclosure.

What is claimed is:

1. A removable unit configured to be removably installed in an apparatus, the removable unit comprising:

a body including a plurality of powered components; and a power supply connector, wherein the power supply connector is in a cover of the removable unit that attaches to the body, the power supply connector being configured to electrically connect a power supply of the apparatus and the plurality of powered components when the removable unit is installed in the apparatus, the power supply having a plurality of power supply terminals at fixed locations, wherein the cover is one of a plurality of replaceable covers attachable to the body, each cover including a plurality of connection portions that connect to the plurality of power supply terminals at the fixed locations, but each cover changes a combination of respective voltages applied to the plurality of powered components.

2. The removable unit according to claim 1, further comprising:

a plurality of electrical conductors; and at least one Zener diode, wherein the plurality of electrical conductors is attached to the power supply connecter and includes a first connection portion, of the plurality of connection portions, connected to one of the plurality of power supply terminals of the power supply when the removable unit is installed in the apparatus and a second connection portion connected to at least one of the plurality of powered components, wherein at least one of the plurality of electrical conductors together with the at least one Zener diode forms a circuit, and wherein at least two of a first cover without the at least one Zener diode, a second cover including the at least one Zener diode disposed in at least one of circuits including the circuit, and at least one third cover including at least one Zener diode having a Zener voltage different from a Zener voltage of the at least one Zener diode of the second cover are replaceable as the cover.

3. The removable unit according to claim 2, further comprising a substrate on which the at least one Zener diode is disposed, the substrate including a first terminal and a second terminal, wherein at least one circuit includes two electrical conductors of the plurality of electrical conductors including an elastic deformable portion having a plate shape or a linear shape, and wherein the elastic deformable portion of one of the two electrical conductors is elastically deformed and in contact with the first terminal of the substrate connected to an anode of the at least one Zener diode, and the elastic deformable portion of other of the two electrical conductors is elastically deformed and in contact with the second terminal of the substrate connected to a cathode of the at least one Zener diode.

4. The removable unit according to claim 3, wherein the first terminal and the second terminal of the substrate are disposed on different surfaces of the substrate from each other, and wherein the elastic deformable portion of the one of the two electrical conductors and the elastic deformable portion of the other of the two electrical conductors sandwich the substrate.

5. The removable unit according to claim 3, wherein the cover includes a projection made of a thermoplastic resin, wherein the projection is thermally melted with the projection of the cover inserted into a hole of the substrate, to secure the substrate to the cover.

6. The removable unit according to claim 3, wherein a sum of the Zener voltage of the at least one Zener diode attached to the cover is smaller than a sum of the Zener voltage of at least one Zener diode of the power supply of the apparatus.

7. The removable unit according to claim 1, wherein the apparatus is an image forming apparatus having an apparatus body, and wherein the removable unit is a process cartridge or a developing device installed in the apparatus body.

8. An image forming apparatus comprising:

an apparatus body; and the removable unit according to claim 1 installed in the apparatus body.

9. The removable unit of claim 1, wherein the cover includes at least one Zener diode connected between terminals connected to respective ones of the plurality of powered components.

10. The removable unit of claim 1, wherein the apparatus is an image forming apparatus and the removable unit includes a photoconductor drum and a developing device.

11. The removable unit of claim 1, wherein the plurality of replaceable covers includes:

a first cover having a first set of connection portions on an outside surface of the first cover, and a second cover having a second set of connection portions on an outside surface of the second cover, wherein the first set of connection portions is different from the second set of connection portions.

12. A removable unit configured to be removable installed in an image forming apparatus, the removable unit comprising:

a developing device;

a plurality of powered components; and a power supply connector configured to electrically connect a power supply of the apparatus and the plurality of powered components when the removable unit is installed in the apparatus, wherein the power supply connector is replaceable with another power supply connector to change a combination of respective voltages applied to the plurality of powered components, the power supply having a plurality of power supply terminals at fixed locations, wherein the power supply connector and the other power supply connector each include a plurality of connection portions that connect to the plurality of power supply terminals at the fixed locations, but each changes a combination of respective voltages applied to the plurality of powered components.

13. The removable unit of claim 12, further comprising a photoconductor drum.

* * * * *